US006354371B1

(12) United States Patent
O'Blanc

(10) Patent No.: US 6,354,371 B1
(45) Date of Patent: Mar. 12, 2002

(54) JET PUMP ASSEMBLY

(76) Inventor: Alton A. O'Blanc, 5869 Andrus Cove Cemetry Rd., Jennings, LA (US) 70546

( * ) Notice: Subject to any disclaimer, the term of this patent is extended or adjusted under 35 U.S.C. 154(b) by 0 days.

(21) Appl. No.: 09/498,194

(22) Filed: Feb. 4, 2000

(51) Int. Cl.[7] ..... E21B 21/10

(52) U.S. Cl. ..... 166/69; 166/154; 166/370; 166/372; 166/374; 417/171; 417/172; 417/177; 417/178; 417/198

(58) Field of Search ..... 406/68, 69, 105, 406/154, 169, 370, 372–374; 417/151, 171, 172, 177, 178, 198

(56) References Cited

U.S. PATENT DOCUMENTS

| | | | | |
|---|---|---|---|---|
| 1,799,483 | A | | 4/1931 | Smith |
| T961,006 | I4 | | 8/1977 | Brown et al. |
| 4,183,722 | A | | 1/1980 | Roeder |
| 4,237,976 | A | | 12/1980 | Wilson |
| 4,436,166 | A | * | 3/1984 | Hayatdavoudi et al. |
| 4,512,420 | A | * | 4/1985 | Hayatdavoudi et al. |
| 4,603,735 | A | | 8/1986 | Black |
| 4,658,893 | A | | 4/1987 | Black |
| 4,790,376 | A | | 12/1988 | Weeks |
| 5,083,609 | A | | 1/1992 | Coleman |
| 5,372,190 | A | | 12/1994 | Coleman |
| 5,862,865 | A | * | 1/1999 | Murray et al. |

* cited by examiner

*Primary Examiner*—Roger Schoeppel
(74) *Attorney, Agent, or Firm*—Browning Bushman

(57) ABSTRACT

A jet pump assembly 10 for use in a subterranean wellbore 82 to lift produced fluids 72 to the surface, comprising a fixed type jet pump assembly 10 including a retrievable insert assembly 30 for retrieving substantially all working components of the jet pump assembly 10 which may be subject to wear or size change, including retrieving the standing valve assembly in the production intake section 50, and having a power section 40 which is reversible such that the same components may be used for operating the jet pump assembly 10 in "normal" circulation or "reverse" circulation. Included is an embodiment of a jet pump assembly 10 providing at least one pressure sensor 90 and at least one temperature sensor 92 built into the through bore of the retrievable insert section 30 for monitoring fluid pressure and temperature in the through bore of the jet pump assembly 10 and thereby improving operational efficiency of the jet pump assembly 10.

20 Claims, 4 Drawing Sheets

JET PUMP ASSEMBLY

FIELD OF THE INVENTION

The present invention relates generally to downhole pump for subterranean wells and more particularly to fixed (conventional) hydraulic jet pump assemblies. More specifically this invention relates to a fixed jet pump having nozzle and throat which may be removed from the well without pulling the well tubing and having pressure sensors integrated into the pump assembly.

BACKGROUND OF THE INVENTION

Hydraulic jet pumps have been a recognized and accepted tool for artificial lift in oil and gas wells for many years. When a well no longer has sufficient reservoir pressure to flow under its own power either to the surface or to flow to the surface at a satisfactory production rate, hydraulic pumping may be an option for lifting the fluid from the wellbore to the surface and through the surface facilities. Hydraulic pumping systems transmit stored potential energy contained in a pressurized source of power fluid to stored potential energy in produced fluids and ultimately to kinetic energy in produced fluids. The power fluid may be part of an open system and originate from the well, such as produced oil or produced water, or the power fluid may be confined to a closed loop system.

A popular hydraulic pump is the jet pump which operates by transferring the energy from a pressurized high velocity jet of power fluid directly to produced fluids drawn into the jet stream by a venturi effect created by the high velocity stream. Produced fluids are mixed with the power fluid and the mixture is lifted to the surface by the hydrostatic energy remaining in the mixture after mixing. Hydraulic jet pumps substantially involve no downhole moving parts. If the pressure drop on the produced fluid stream into the jet pump is sufficiently great, a suction may actually be created upon the face of the producing formation at the wellbore. Therefore, jet pumps may also be known as formation suction pumps.

Hydraulic jet pumps are dynamic pumps, as are electric submersible pumps and are to be distinguished from hydrostatic pumps such as reciprocating rod pumps. The objective in jet pumping is to create as much bottom hole pressure draw-down as possible in order to obtain maximum production rate. By altering the variable sizes of component parts, power fluid rate and pressure, jet pumps are capable of producing wells at produced fluid rates from less than 50 barrels of fluid per day (BFDP) to in excess of 10,000 BFPD. As such, in order to optimize system efficiency or resize pump components to adjust to changing well capabilities, it may be necessary to remove a pump rather frequently to make these adjustments. Cavitation, turbulence and friction may become excessive and result in operating inefficiencies in improperly designed jet pump systems, leading to excessive horsepower requirements and component wear. Depending upon the installation design, these problems may require pulling the power fluid tubing string from the well, and/or a production tubing string, and/or the jet pump assembly. In some installation designs the entire pump may be pumped to the surface by reversing flow of the produced and power fluid streams.

There are basically two distinct types of jet pumps. The first may be known as "fixed pump" installations and the second may be known as "free pump" installations. In "fixed pump" installations, the jet pump is run in the wellbore affixed to the power fluid tubing string. There are substantially two basic designs of fixed pump installations. In the first fixed pump installation, the jet pump is attached to the power fluid tubing string and the pump and power fluid tubing string are run inside of a larger tubing string, referred to as the production tubing string, and the pump is landed on a seating shoe which is attached near the bottom of the production tubing string. In this "insert" type installation, power fluid may traverse down the inner power fluid tubing string, pass through the pump and the mixture of power fluid and produced fluid may be transmitted to the surface through the annulus between the two tubing strings. Alternatively, the fluid directions may be reversed. In this insert type, fixed jet pump installation, free gas may be vented up the annulus between the outer production tubing string and the casing. In addition, this installation may allow a larger diameter pump to be run in relatively small casing sizes. Power fluid strings in this installation may typically range in size from ¾ inch to 1¼ inches, depending upon rate, pressure and production tubing size.

In the second fixed pump installation, the jet pump may be run in the wellbore on the power fluid tubing string and include a pack-off device, such as a packer, to seal between the power fluid tubing string and the well casing. Power fluid may typically travel down the power fluid tubing string, pass through the pump and return to the surface with the produced fluid, up the tubing/casing annulus. In this installation, produced gas must be handled by the pump. Therefore, this installation may typically be most applicable to well having low gas volumes and to wells having a relatively high production capacity.

In "free pump" installations, a relatively large tubing string may be run into a wellbore. A bottom hole assembly including a packer and standing valve may be run into the wellbore, concentrically through the larger tubing string, either on a smaller diameter, power fluid tubing string or on wireline. The packer may then be set in the annulus between the tubing strings and above the casing perforations. The "free pump" may then be circulated into the wellbore through the inner, power fluid tubing string and landed on the standing valve. Mixed power fluid and production fluid may then be produced to the surface through the annulus between the two tubing strings. The jet pump may be circulated out of the wellbore as desired to change or resize components in the pump by reversing the fluid directions, causing the standing valve ball to seat in the standing valve.

A free pump may also be retrieved by wireline operations. The free pump type casing installation may also be advantageous where production or power fluid may be transmitted through the wellbore casing, in that this installation only requires the purchase of one tubing string. A significant difference in the free pump casing installation and the fixed pump casing installation is that in the fixed pump casing installation the jet pump is attached to the power fluid tubing string and in the free pump installation the jet pump fits inside of the power fluid tubing string allowing the free pump to be circulated up and down the power fluid string.

In either the free pump installation or the fixed pump installation, the direction of flow for the power fluid and the mixed power and produced fluids may be in either direction such that the power fluid may be selectively transmitted down either the inner tubing string, or down the annulus between tubing strings or between the tubing casing annulus. However, internal components of the jet pump must be directionally oriented to properly accommodate the selected operating practice.

Technical references to jet pumps are known as far back as 1852, however, the first suggestion of an application to pumping oil wells, with a mathematical approach, was first disclosed in 1933. In 1864 Anger and Crocker were granted U.S. Pat. No. 44,587, on a jet pump. McMahon received six patents on oil well pumps beginning in 1930 with U.S. Pat. No. 1,799,483. Jet pumps began to achieve more accepted usage and with emphasized marketing in the oil patch in the 1970's. U.S. Pat. No. T961,006 was granted to Brown in 1977, disclosing a method of controlling cavitation in jet pumps by high pump submergence below the producing formation, in a wellbore. A significant drawback to this invention is that it may require additional cost to drill, case and complete additional rat hole below the producing formation. In 1980, Roeder was granted U.S. Pat. No. 4,183,722, disclosing a jet pump including a conical deflector positioned in the axial center of the diffuser in order to effect more intimate contact of the power fluid with the produced fluid in order to increase the efficiency of the pump.

U.S. Pat. No. 4,237,976 was issued in 1980 to Wilson, disclosing a standard free pump type of jet pump installation. In the 976 patent, a packer is set above a producing interval on tubing and the tubing is perforated above a standing valve and landing nipple in the bottom hole assembly. A jet pump is pumped down the tubing and seated in the landing nipple while also sealing with the tubing above the perforation, such that power fluids may be pumped down the tubing and mixed power and produced fluids are transferred to the surface through the tubing/casing annulus.

In 1986, U.S. Pat. No. 4,603,735 was issued to Black, disclosing a conventional fixed pump insert type jet pump installation, as opposed to a fixed pump casing type installation. In the 735 patent, power fluid is pumped down the inner concentric tubing string, as done under prior art. This design differs from prior art in that the power fluid enters a venturi throat from below the venturi, as opposed to being accelerated through a jet nozzle, and accelerated fluid jet stream is discharged above the venturi. In addition, produced fluids are not drawn into the axial entrance to the venturi. Instead, produced fluids are drawn into the jet stream from a side port within the venturi throat.

In 1987, Black was issued another patent, U.S. Pat. No. 4,658,893, disclosing a variation to the previous fixed type insert pump installation. In the '893 patent, the jet pump assembly, less the throat and nozzle, is run inside of the casing on a production tubing string, such as 2⅜ inch or 2⅞ inch. The throat and nozzle assembly is then run inside of the production tubing string on a smaller tubing string, such as a one inch string. The throat and nozzle are then inserted into the jet pump in an insertion conduit in the jet pump. Power fluid is then pumped down the smaller, inner string, through the pump and the mixed fluids are produced up the annulus between the two tubing strings.

In 1988, Weeks was granted U.S. Pat. No. 4,790,376, disclosing a fixed type insert pump which may be operated in convention circulation or in reverse circulation, such that in either installation the jet nozzle is oriented toward the surface. In 1992, U.S. Pat. No. 5,083,609 was granted to Coleman, disclosing modifications to concepts put forth in the '893 patent granted previously to Black. Two balls were provided in the standing valve component of the '609 patent as opposed to the single ball standing valve provided in the previous '893 patent. Also, the '609 pump is primarily a fixed type jet pump, in that it has a specially designed pump housing that must be run on the end of a tubing string, resulting in additional cost and complexity. The pump of the '609 patent is also somewhat of a free pump in that a substantial portion of the pump assembly may be separately removed from the hole, as opposed to pulling merely the throat and nozzle as in the '893 patent. The pump of the '609 patent is also complicated and relatively inefficient due to the number of intricacies, port-holes and fluid passageways. The 'pump of the 609 patent additionally also embodies the use of concentric tubing strings.

U.S. Pat. No. 5,372,190, also granted to Coleman, discloses a conventional type insert pump assembly which is a modification of the '609 patent granted previously to Coleman, with the '190 patent embodying differing structural details and operational characteristics. The jet pump of the '190 patent is a conventional insert type jet pump, in that a pump housing is run in the wellbore on the end of tubing and embodies an inner concentric tubing string. The nozzle and throat may also be separately retrieved from the wellbore through the inner tubing string by reverse pumping or recovered on wireline.

An improved jet pump design is desired in order to improve mechanical system efficiency, simplify operational characteristics and provide the characteristic advantages of free pumps in a fixed pump installation. A simplified jet pump is desired which offers the ability to retrieve substantially all operational components of the jet pump assembly, including the standing valve assembly, while selectively operating the well in either operational direction and using the same pump components in either pumping direction. The disadvantages of prior art are overcome by the present invention and an improved jet pump installation is hereinafter disclosed.

SUMMARY OF THE INVENTION

A suitable embodiment of a jet pump assembly according to the present invention includes a fixed type jet pump installation having a retrievable insert assembly which may facilitate operation of the jet pump assembly in a normal circulation installation or in a reverse circulation installation. A simplified jet pump is provided which offers the ability to retrieve substantially all operational components of the jet pump assembly, including the standing valve assembly, without pulling either tubular conduit string, while selectively changing the direction of fluid circulation in the jet pump assembly and using the same pump components in either pumping direction.

A jet pump housing is provided which may be attached to the inner tubing string, similar to a fixed pump installation. In addition, a jet pump insert assembly is provided which includes substantially all of the working pump components, such that all of the insert assembly may be retrievable in one retrieving operation, by either wireline or by pumping the assembly from the housing, without pulling either tubular conduit from the wellbore.

It is an objective of the present invention to improve operational options with a given jet pump assembly. Connections are provided which permit key power section components to be directionally re-oriented and reconnected with the remaining pump components such that the insert assembly is operationally functional for pumping produced fluids either up the inner tubular conduit or up the annulus between the tubular conduits. This retrievability feature affords this invention desirable characteristics of free pump designs while also avoiding the problem of changing to different pump components or a completely different pump for changing the operational direction of fluid flow through the tubular conduits and through the jet pump.

It is also an objective of this invention to provide a simplified design, fixed type jet pump installation having retrievable components. When removed from the wellbore, the retrievable insert assembly of this invention recovers substantially all working components of the jet pump system which maybe subject to wear, resizing or operational modifications.

Another objective of this invention it to provide a jet pump assembly which may provide for pressure and temperature sensing and measuring equipment to be built into the recoverable insert assembly in the pump. The pressure and temperature measuring equipment may measure and record pressure and temperature of power fluid, produced fluid and mixed fluid streams, inside of the through bore in the jet pump assembly. Designed to be a permanent part of the installation, the pressure and temperature information may be selectively recorded and transmitted to the surface to monitor conditions at various selectable points in the jet pump assembly for optimizing the initial installation of the jet pump assembly. In addition, pressure and temperature conditions may be selectively polled at subsequent points in time in the life of the installation in order to monitor operating conditions and make operational adjustments in system performance.

It is a feature of the present invention to optimize system efficiency through analyzing pressure and/or temperature data from within the interior passages of the jet pump assembly in order to optimize system efficiency. Changes in power fluid pump rates and pressures, back-pressure regulator settings, and power fluid type may be monitored and changed during the life of the well as well production fluid characteristics change. Increases in gas-liquid ratios may be accounted for in optimizing power fluid rates. Changes in pump performance due to wear may also be directly measured by pressure and/or temperature recorders positioned at selected positions within the jet pump assembly.

It is also a feature of the present invention that the jet pump assembly may be cost effective to install and operate over the life of the installation. The retrievability feature provides for changing pump components without requiring pulling the tubing. Recording pressures and/or temperatures at various points in the jet pump facilitates fine tuning the jet pump assembly, both in initial operating characteristics, and as pump and well conditions change due to wear and well productivity changes.

These and further objects, features and advantages of the present invention will become apparent from the following detailed description, wherein reference is made to the figures in the accompanying drawing.

DETAILED DESCRIPTION PREFERRED EMBODIMENTS

Figure 1:
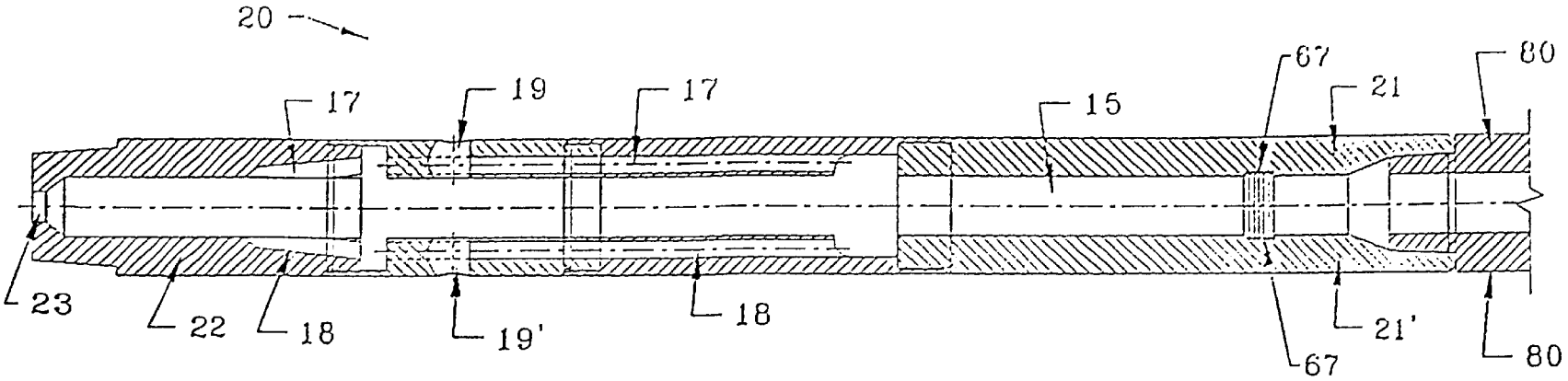
FIG. 1 is a cross-section illustration of an embodiment of a pump housing, shown with the insert assembly absent.
Figure 2:
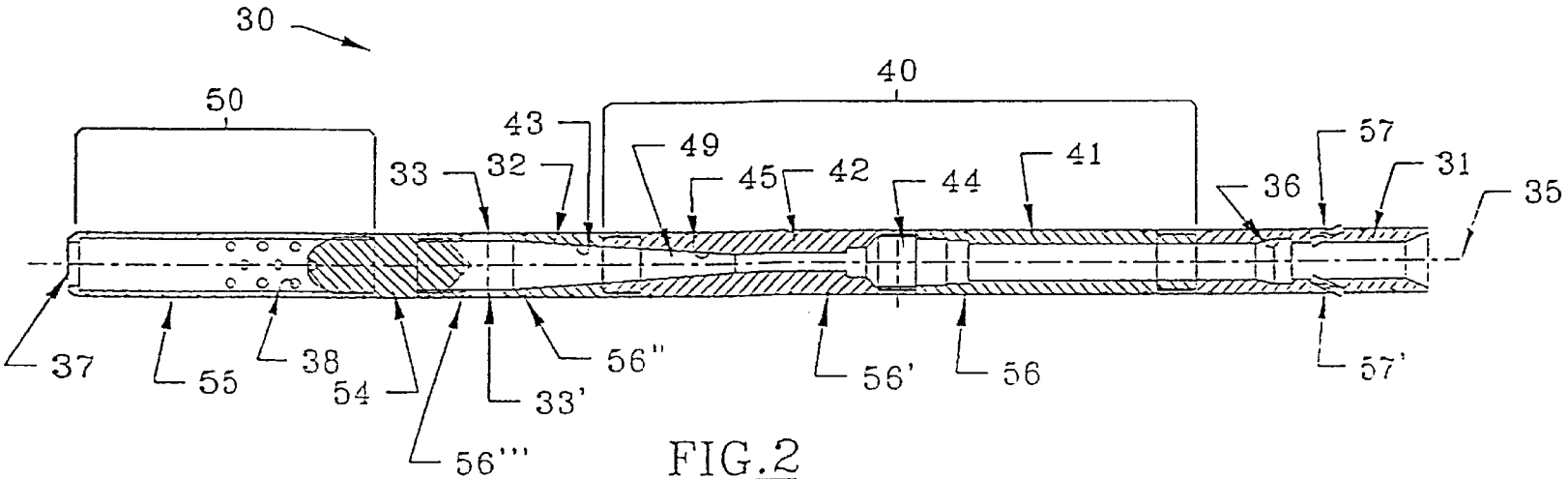
FIG. 2 is a cross-section illustration of an insert assembly without the throat insert, nozzle, standing valve and cage, with the power section oriented for "normal" operations, by pumping power fluid down an inner tubular conduit and transmitting mixed power and produced fluids up the annulus between the inner and an outer tubular conduit.
Figure 3:
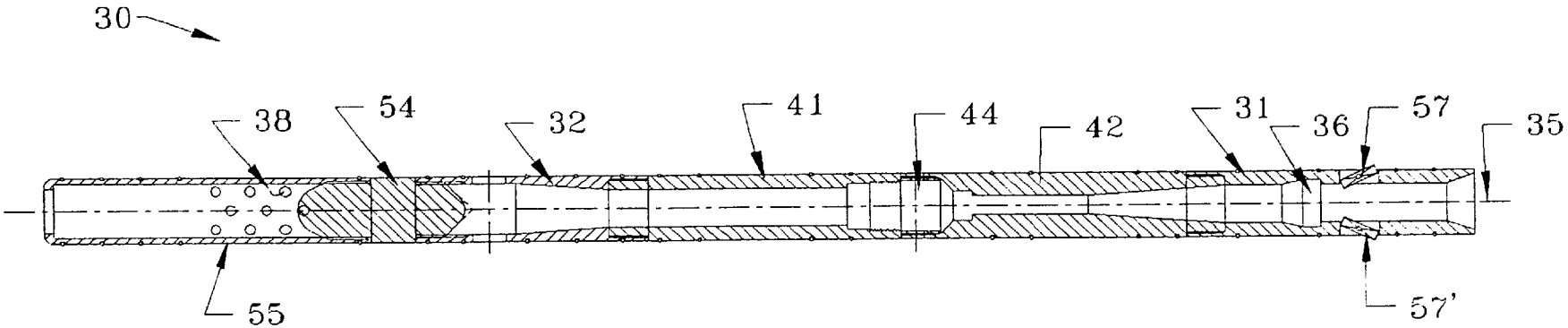
FIG. 3 is a cross-section illustration of an insert assembly without the throat insert, nozzle, standing valve and cage, with the power section oriented for "reverse" operations, by pumping power fluid down the annulus between an inner and an outer tubular conduit and transmitting mixed power and produced fluids up the annulus between the inner and an outer tubular conduit.
Figure 5:
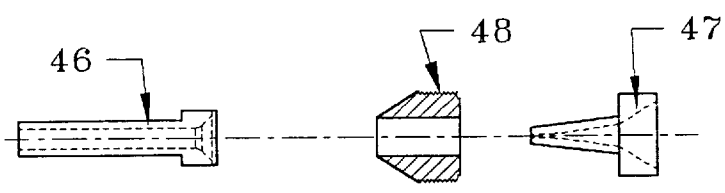
FIG. 5 is a cross-section illustration of power section components removed from within the power section, including a throat insert, a nozzle retainer and a nozzle.

FIGS. 1, 2, 4, 5 and 6 illustrate a suitable embodiment for a jet pump assembly 10 for pumping produced fluids from a subterranean wellbore 82. The jet pump assembly 10 may generally include a pump housing assembly 20, an insert assembly 30, an inner, first tubular conduit 80 and an outer, second tubular conduit 81. The jet pump assembly 10 may also include a power fluid 71, a produced fluid 72 and a mixture fluid 73, comprised of power fluid 71 and produced fluid 72. A packoff seal 85 may hydraulically isolate produced fluid 72 from the mixed fluid 73 in an annulus between the pump housing 20 and the second tubular conduit 81.

Figure 6:
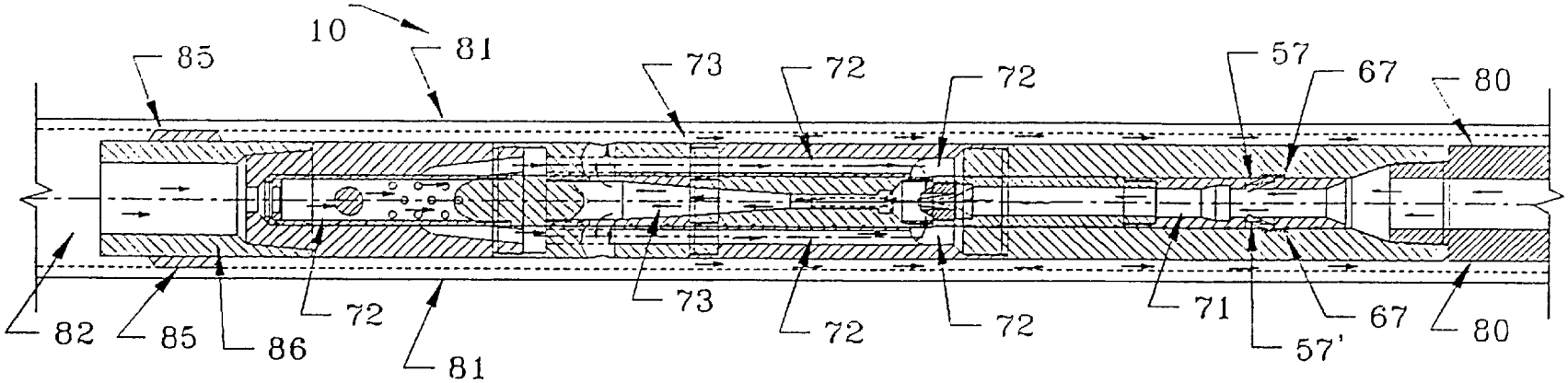
FIG. 6 is a cross-section illustration of a jet pump assembly connected to an inner tubular conduit and suspended within a well-bore and within a second tubular conduit, configured for "normal" fluid circulation, and illustrating the insert assembly positioned in the pump housing.

In a preferred embodiment, as illustrated in FIG. 6 and referring to FIGS. 1, 2, 4 and 5, the jet pump assembly 10 may be positioned downhole in a subterranean wellbore 82 for transmitting produced fluid 72 from downhole in the wellbore 82 to processing and receiving facilities at the surface. The wellbore 82 may include a second tubular conduit 81 which may extend from a downhole position in the wellbore 82 to the surface. The second tubular conduit 81 may include a well casing or a second tubing string. The pump housing assembly 20 may be suspended from the downhole end of a first tubular conduit 80 and is selectively positioned downhole in the wellbore 82. The first tubular conduit 80 may extend from the downhole position in the wellbore 82 where the first tubular conduit 80 is attached to the pump housing 20, to the surface. The pump housing 20 may include a produced fluid inlet 23 substantially near a production intake end 22 of the pump housing 20, and the pump housing 20 may also include at least one and preferably two produced fluid conduits 17, 18 for transmitting produced fluid 72 from substantially near the produced fluid inlet 23 to a mixing area 44 where the produced fluid 72 may be mixed with the power fluid 71. The pump housing 30 may also include at least one and preferably two housing circulation ports 19, 19'. In addition, the pump housing 20 may include a through bore along a central axis 15.

The insert assembly 30 generally comprises an assembly of components to be retrievably positioned in the jet pump assembly 10. The insert assembly may include a through bore extending substantially from an insert tubing end of the insert assembly 30 to an insert production intake end of the insert assembly 30. Components of the insert assembly 30 may generally share a common central axis 35. Hydraulic seals maybe formed between the pump housing 20 and the insert assembly 30, such as by O-rings 56, 56', 56", 56'". In operative pumping service, the insert assembly 30 is located within the pump housing 20. The insert assembly 30 includes a diverter plug 54 which partially plugs a portion of the internal through bore in the insert assembly 30, hydraulically isolating a production intake section 50 of the insert assembly 30 from components of the power section 40. The insert assembly 30 may be retrieved to the surface from within the pump housing 20 without pulling the pump housing 20 or the first tubular conduit 80 by either reversing the direction of power fluid flow, thereby causing the insert assembly 30 to be hydraulically ejected from within the pump housing 20. Alternatively, the insert assembly 30 may be retrieved on wireline.

Retrieval of the insert assembly 30 may facilitate removal of substantially all wear components and pump components which may need to be resized. In addition, the logistical operation of the jet pump assembly 10 may be changed from a normal circulation concept to a reverse circulation concept, as those terms are generally understood in the oil and gas producing industry. This invention facilitates effecting this operational change while using the same pump components in either operational configuration, by merely re-orienting a reversible sub-assembly of the insert assembly 30. The reversible sub-assembly may be referred to as the power section 40.

The power section 40 may include connectors on each end of the power section 40 which are common to mating connectors on the adjacent components. Components adjacent the power section 40, which are not part of the power section 40 but which are part of the insert assembly 30, include an upper insert adapter 31 and a lower insert adapter 32. Components of the power section 40 include a nozzle inlet body 41, a mixing tube body 42, a nozzle 47 and a throat insert 46. The power section 40 may also include a nozzle retainer 48. In either orientation of the power section 40, a mixing tube end of the nozzle inlet body 41 may be connected with a nozzle inlet body end of the mixing tube body 42. When the power section 40 is oriented for operation in a "normal" circulation configuration, which is also a preferred orientation, a fluid inlet end of the nozzle inlet body 41 is connected to the upper insert adapter 31, and a fluid discharge end of the mixing tube body is connected to the lower insert adapter 32. A nozzle 47 may be positioned in the nozzle inlet body 41 and a throat insert 46 may be positioned in the mixing tube body 42. The mixing tube body 42 may include an internal, frustoconical taper 45 in the through bore of the mixing tube body 42, tapering from a discharge end of the throat insert 46 to the discharge end of the mixing tube body 42. The taper serves as a diffuser to expand the mixed fluid 73 as the mixed fluid 73 exits the throat insert 46, in order to reduced mixed fluid 73 velocity and increase hydrostatic pressure in the mixed fluid 73.

In a preferred embodiment, the upper insert adapter 31 may connect between the first tubular conduit 80 and the power section 40. The upper insert adapter 31 may also include a profile 36 for engaging a common retrieving tool with the insert assembly 10 for retrieving the insert assembly 10 with wireline. The lower insert adapter 32 may connect in the insert assembly 10 between the diverter plug 54 and the power section 40. The lower insert adapter 32 may also include at least one and preferably two insert circulation ports 33, 33' to hydraulically connect the through bore of the insert assembly 30 with the at least one and preferably two housing circulation ports 19, 19'. The lower insert adapter 32 may include an internal frustoconical taper 43, tapering from the connection with the power section 40 to substantially near the insert circulation port 33, 33'. The taper serves to reduce the velocity and expand the mixed fluid 73 as the mixed fluid 73 exits the power section 40.

Figure 4:
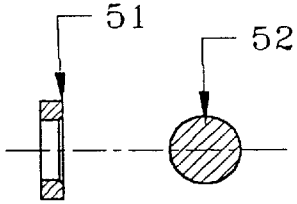
FIG. 4 is a cross-section illustration of standing valve components removed from within an insert assembly, including a ball, seat and cage.
Figure 7:
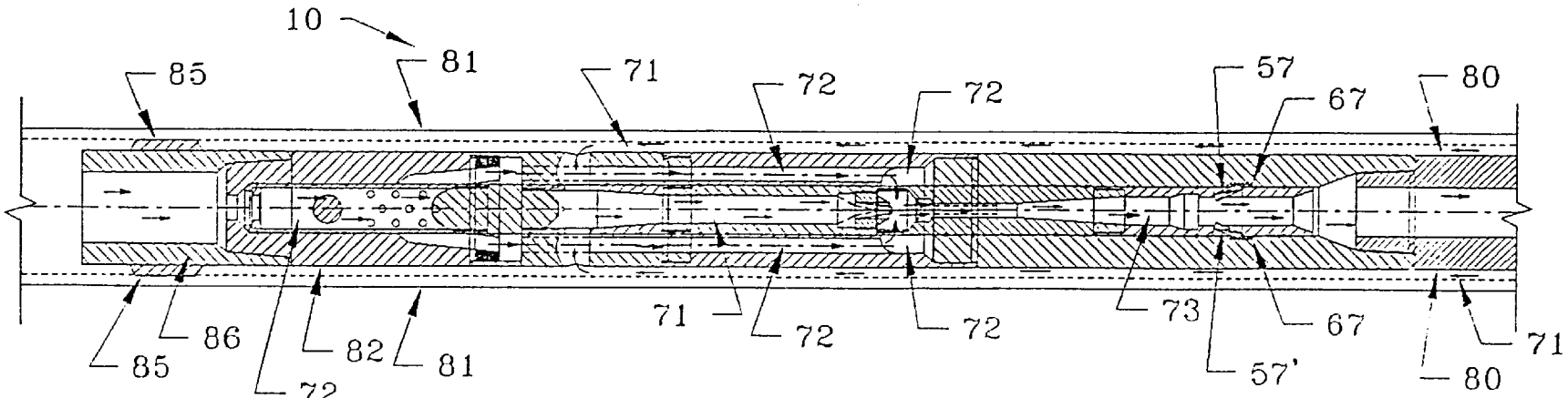
FIG. 7 is a cross-section illustration of a jet pump assembly connected to an inner tubular conduit and suspended within a well-bore and within a second tubular conduit, configured for "reverse" fluid circulation, and illustrating the insert assembly positioned in the pump housing.

The insert assembly 20 also includes a production intake section 50. The production intake section 50 may include an insert produced fluid port 37 to facilitate the introduction of produced fluid 72 from the housing produced fluid inlet 23 into the through bore in the production intake section 50. The insert assembly may include a production intake conduit 55 which may provide an enclosure or cage for housing a standing valve or ball 51 and seat 52 check valve arrangement, as illustrated in FIGS. 4, 6 and 7. A production outlet end of the production intake section 50 may generally be connected to the diverter plug 54. The production outlet end of the production intake section 50 may also include an array of produced fluid outlet ports 38, or other outlet configuration, for transmitting produced fluid 72 from the through bore of the production intake section 50 to the at least one and preferably two produced fluid conduits 17, 18 in the pump housing 20. The production intake section 50 may also include a ball 52 and seat 51 "check-valve" or "standing valve" arrangement to prevent the produced fluid 72 and the mixed fluid 73 from falling back from within the first or second tubular conduit 80 or 81, into the wellbore 82 when pumping is interrupted. A standing valve cage may also be included for confining the ball 52 substantially near the seat 51.

Figure 8:
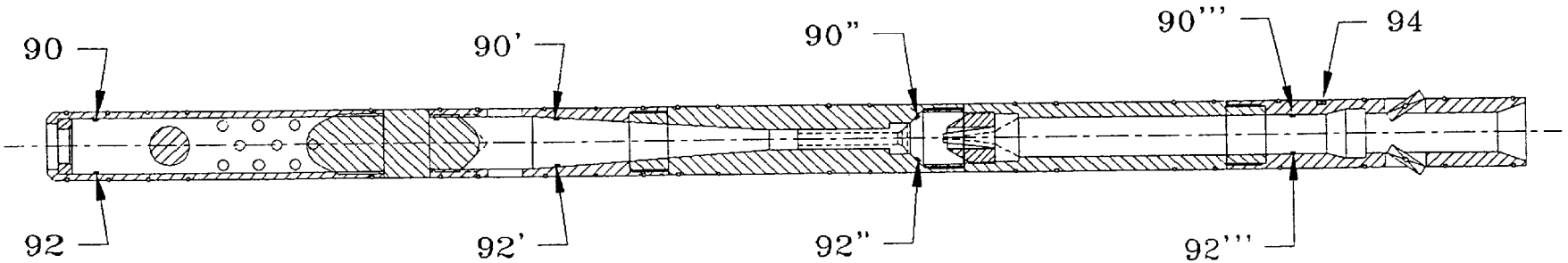
FIG. 8 is a cross-section illustration of an insert assembly including pressure and temperature sensors within the insert assembly.

Referring to FIG. 8, an alternative embodiment of a jet pump assembly 10 may also include at least one pressure sensor 90 or an array of pressure sensors 90, 90', 90", 90'" integrated into the insert assembly 30 to measure pressure of various fluids at select points in the through bore of the insert assembly 30, while the jet pump 10 is operating. The insert assembly 30 may also include at least one temperature sensor 92 or an array of temperature sensors 90, 90', 90", 90'", any or all of which may be built into the insert assembly 30 to measure fluid temperature at various select points in the through bore of the insert assembly 30, while the jet pump 10 is operating. It is preferable to provide a first pressure sensor 90 and/or first temperature sensor 92 in the production inlet end of the pump to measure fluid pressure in the produced fluid available at the pump intake. It may also be preferable to provide a second pressure sensor 90' and/or a second temperature sensor 92' substantially downstream of the mixing tube body 42, in the expansion region 49, to measure static pressure and temperature available for lifting the mixed fluid 73 to the surface. It may be preferable to provide a third pressure sensor 92" and/or third temperature sensor 92" in the mixing area 44 to measure fluid pressure and/or temperature in the substantially near the created venturi effect to sense pressure draw-down in the mixing area. It may also be preferable to include a fourth pressure sensor 90'" and/or fourth temperature sensor 92'" upstream of the nozzle 47 to measure the static pressure and temperature of the power fluid 72 available substantially at the nozzle 47.

The pressure and/or temperature data may be selectively sensed and transmitted by a transmitter 94 located downhole for transmission to a receiver (not shown) preferably located at the surface for storage, retrieval or processing pressure and/or temperature signal data to be used in improving operational efficiency of the jet pump assembly 10. Transmission from downhole to the surface may be by radio signal, hard wire connection, fiber optic or other transmission mechanism. Operational improvements may thereby be obtained during startup stages of a jet pump installation in optimizing the selection of throat insert 46 size, nozzle 47 size, fluid pressure and rate, and setting depth of the jet pump assembly 10. The directional orientation of the power section 40 may also be reversed such that circulation of power fluid 71 and mixed fluid 73 may be reversed. Power fluid 71 pressure and flow rate may be varied. Other benefits may also be obtained from pressure and temperature data by selectively polling the pressure and temperature sensing or measuring devices during operation of the jet pump assembly 10 to monitor component wear and make appropriate operational adjustments. Such pressure and temperature information may also be useful in monitoring well productivity changes during the life of the well.

As illustrated in FIG. 6 and referring to FIGS. 1, 2, 4 and 5, a preferred method of operating a jet pump assembly 10 includes suspending the jet pump assembly 10 in a wellbore 82 from a first tubular conduit 80 while the jet pump assembly 10 and the first tubular conduit 80 are enclosed in a second tubular conduit 80, such as a second tubing string or a well casing. The annular area between the jet pump assembly 10 and the second tubular conduit 80 may be hydraulically sealed by a packoff 85 such as a packer. The packoff 85 may be provided on a housing packoff mandrel 86, which may be positioned on the downhole end of the jet pump assembly 10.

A housing tubing end 21 of the pump housing 20 may be connected to a downhole end of the first tubular conduit 80. The surface end of the first tubular conduit 80 may be connected to a power fluid source to transmit pressurized power fluid 71 from the power fluid source at the surface (not shown) to the jet pump assembly 10 located downhole in the wellbore 82. The second tubular conduit 81 may be connected at the surface to a production facility to process and receive the mixed fluid 73. The insert assembly 30 may be inserted into the pump housing 20, and a hydraulic seal may be formed between the insert assembly 30 and the pump housing 20, such as by O-rings 56, 56', 56", 56'".

At the surface, pressure may be applied to the power fluid 71 in the first tubular conduit 80. Potential energy in the pressurized power fluid 71 provided from the surface and transmitted downhole to the jet pump assembly 10 may be converted to kinetic energy by accelerating the power fluid 71 through a restricted diameter nozzle 47 in the insert assembly 30, thereby vastly increasing velocity in the power fluid 71. When the power fluid jet exits the nozzle 47, the high velocity of the power fluid 71 may create a low pressure region substantially adjacent the power fluid stream, and may draw produced fluid 72 from the wellbore 82, into the production intake section 50, through the production conduits 17, 18 in the pump housing, and into a mixing area in the power section 40 of the insert assembly 30. The mixing area in the insert assembly 30 may be located generally between the nozzle 47 and the throat insert 46. The power fluid 71 and the produced fluid 72 may engage one another in the mixing area where momentum from the power fluid 71 is transferred to the produced fluid 72, causing the power fluid 71 and the produced fluid 72 to mix as they are both drawn into and along the through bore of the throat insert 46. When the mixed fluid 73 exits the throat insert 46, the mixed fluid 73 enters an expansion region 49 in the mixing tube body 42. The expansion region 49 may also be referred to as a diffuser 49. In the diffuser 49 of the mixing tube body 42, remaining kinetic energy in the mixed fluid 73 is converted to hydrostatic pressure by reducing the velocity of the mixed fluid 73. The mixed fluid 73 may exit the through bore of the lower insert adapter 32 through the at least one insert circulation port 33, 33', then through the at least one housing circulation port 19, 19' and then into the annulus between the pump housing 20 and the ID of the second tubular conduit 81. The hydrostatic pressure in the mixed fluid 73 may be sufficient to lift the mixed fluid 73 to the surface through the annulus between the OD of the first tubular conduit 80 and the ID of the second tubular conduit 81.

To retrieve the insert section 30, power fluid 71 may be transmitted down the annulus between the OD of the first tubular conduit 80 and the ID of the second tubular conduit 81, causing the insert assembly 30 to disengage from the pump housing 20 and the insert assembly 30 may be pumped to the surface. Alternatively, the insert assembly 30 may be retrieved from the pump housing 20 by wireline recovery.

As illustrated in FIG. 7 and referring to FIGS. 1, 2, 3, 4 and 5, in an alternative embodiment, the power section 40 of the jet pump assembly 10 may be operated in a "reverse" flow circulation pattern. To change from the "normal" fluid flow circulation to a "reverse" fluid flow circulation pattern, the insert assembly 30 may be retrieved and the power section 40 of the insert assembly 30 will be reversed 180 degrees. To reverse the power section 40, a connection between the inlet end of the nozzle inlet body 41 and the upper insert adapter 31 is disconnected, the connection between the discharge end of the mixing tube body 42 and the lower insert adapter 32 is disconnected. The power section 40 is then inverted 180 degrees and the inlet end of the nozzle inlet body 41 is connected with the lower insert adapter 32, and the discharge end of the mixing tube body 42 is connected with the upper insert adapter 31. The insert assembly 30 may then be reinserted in the pump housing 20 by pumping the insert assembly 30 down the first tubular conduit 80. In the reverse circulation installation, power fluid 71 is pumped down the second tubular conduit 80, through the at least one housing circulation port 19, 19', through the at least one insert circulation port 33, 33', through the power section 40 and then to the surface through the first tubular conduit 80.

Referring to FIGS. 1, 2, 3, 6 and 7, in a jet pump assembly 10 installation operating in the reverse circulation mode, the insert assembly 30 may include an insert assembly retainer 57, 57' and retainer grooves 67 in the pump housing 20 to assist in securing the insert assembly 30 in the jet pump housing 20. Common retrieving tools may simultaneously disengage the insert assembly retainer 57, 57' from engagement with the pump housing 20 to retrieve the insert assembly 30, such as on wireline.

It may be appreciated that various changes to the methods or steps herein, as well as in the details of the illustrations, methods and systems may be made within the scope of the attached claims without departing from the spirit of the invention. While preferred embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

What is claimed:

1. An improved jet pump assembly for positioning downhole in a subterranean wellbore, the jet pump assembly producing fluids from the subterranean wellbore, the jet pump assembly being suspended in the wellbore from a first tubular conduit, the jet pump assembly and the first tubular conduit enclosed in a second tubular conduit, a packoff seal hydraulically sealing the annular area between the jet pump assembly and the second tubular conduit, the jet pump assembly comprising:

a pump housing having a housing tubing end and a housing production intake end, the pump housing having an internal through bore extending between the housing tubing end and the housing production intake end, the housing tubing end of the pump housing being connected to a downhole end of the first tubular conduit, the pump housing and the first tubular conduit suspended in the wellbore in the second tubular conduit, the pump housing including a production inlet port in the production intake end of the pump housing, at least one produced fluid conduit conducting produced fluid from the production intake end of the pump housing to a mixing area in an insert assembly, and the pump housing including at least one circulation port to conduct fluid through the wall of the pump housing between the second tubular conduit and a through bore of the insert assembly;

the insert assembly within the pump housing, the insert assembly having an insert tubing end and an insert production intake end, the insert assembly having an internal through bore extending between the insert tubing end and the insert production intake end, the insert assembly being selectively retrievable from and selectively locatable in the pump housing while the pump housing remains in the wellbore supported from the first tubular conduit, the insert assembly including a power section where energy is imparted into the produced fluid to lift the produced fluid to the surface, a production intake section to conduct fluid from the production inlet port of the pump housing to the at least one produced fluid conduit, a diverter plug plugging a portion of the internal through bore in the insert assembly, a lower insert adapter connecting the production intake section to the power section, and an upper insert adapter connecting the first tubular conduit to the power section;

the power section having an power section intake end and a power section discharge end, the power section having an internal through bore extending between the power section intake end and the power section discharge end, the power section including a nozzle inlet body supporting a nozzle, the nozzle creating a pressure drop in a power fluid and accelerating the power fluid, a throat insert providing a conduit for mixing the produced fluid and the power fluid, and a mixing tube body supporting the throat insert, the power section being reversible and including connectors on each end of the power section that interchangeably connect with mating connectors on the upper insert adapter and the lower insert adapter such that the orientation of the power section may be reversed in order to selectively recover produced fluid from the wellbore through one of the first or second tubular conduits; and the production intake section of the insert assembly having a fluid inlet end and a diverter plug end, the production intake section having an internal through bore extending between the fluid inlet end and the diverter plug end, the production intake section including the standing valve assembly to prevent back-flow of fluids into a lower end of the wellbore from within one of the first and second tubular conduits, and an outlet port conducting fluid from the internal through bore of the production intake section to the at least one produced fluid conduit in the pump housing.

2. The jet pump assembly as defined in claim 1, further comprising:

an insert assembly retainer to releasably retain the insert assembly in the pump housing.

3. The jet pump assembly as defined in claim 1, further comprising:

a nozzle retainer to retain the nozzle in the nozzle inlet body.

4. The jet pump assembly as defined in claim 1, further comprising:

at least one insert seal to hydraulically seal an annulus between the insert assembly and the pump housing.

5. An improved jet pump assembly for positioning downhole in a subterranean wellbore, the jet pump assembly producing fluids from the subterranean wellbore, the jet pump assembly being suspended in the wellbore from a first tubular conduit, the jet pump assembly and the first tubular conduit enclosed in a second tubular conduit, a packoff seal hydraulically sealing the annular area between the jet pump assembly and the second tubular conduit, the jet pump assembly comprising:

a pump housing having a housing tubing end and a housing production intake end, the pump housing having an internal through bore extending between the housing tubing end and the housing production intake end, the housing tubing end of the pump housing being connected to the first tubular conduit, the pump housing and the first tubular conduit suspended in the wellbore in the second tubular conduit, the pump housing including a production inlet port in the production intake end of the pump housing, at least one produced fluid conduit conducting produced fluid from the production intake end of the pump housing to a mixing area in an insert assembly, and the pump housing including at least one circulation port to conduct fluid through the wall of the pump housing between the second tubular conduit and a through bore of the insert assembly;

the insert assembly within the pump housing, the insert assembly having an insert tubing end and an insert production intake end, the insert assembly having an internal through bore extending between the insert tubing end and the insert production intake end, the insert assembly including a power section imparting energy into the produced fluid to lift the produced fluid to the surface, a production intake section conducting fluid from the production inlet port of the pump housing to the at least one produced fluid conduit, a diverter plug plugging a portion of the internal through bore in the insert assembly, a lower insert adapter connecting the production intake section to the power section, and an upper insert adapter connecting the first tubular conduit to the power section;

the power section having an power section intake end and a power section discharge end, the power section having an internal through bore extending between the power section intake end and the power section discharge end, the power section including a nozzle inlet body supporting a nozzle, the nozzle creating a pressure drop in the power fluid and accelerating a power fluid, a throat insert providing a conduit for mixing the produced fluid and the power fluid, and a mixing tube body supporting the throat insert to selectively recover produced fluid from the wellbore to the surface through one of the first or second tubular conduits;

the production intake section of the insert assembly having a fluid inlet end and a diverter plug end, the production intake section having an internal through bore extending between the fluid inlet end and the diverter plug end, the diverter plug plugging a portion of the internal through bore in the production intake section of the insert assembly, the production intake section including a standing valve assembly and an outlet port; and at least one pressure sensor positioned in the insert assembly to sense fluid pressure in the through bore of the insert assembly.

6. The jet pump assembly as defined in claim 5, further comprising:

the at least one pressure sensor sensing power fluid pressure upstream of the nozzle.

7. The jet pump assembly as defined in claim 5, further comprising:

the at least one pressure sensor sensing fluid pressure in the mixing area.

8. The jet pump assembly as defined in claim 5, further comprising:

the at least one pressure sensor sensing fluid pressure downstream of the throat insert and upstream of the insert circulation port.

9. The jet pump assembly as defined in claim 5, further comprising:

the at least one pressure sensor sensing fluid pressure of the produced fluid in the through bore of the production intake section.

10. The jet pump assembly as defined in claim 5, further comprising:

at least one temperature sensor positioned in the insert assembly to sense fluid temperature in the through bore of the insert assembly.

11. The jet pump assembly as defined in claim 10, further comprising:

the at least one temperature sensor sensing power fluid temperature upstream of the nozzle.

12. The jet pump assembly as defined in claim 10, further comprising:

the at least one temperature sensor sensing fluid temperature in the mixing area.

13. The jet pump assembly as defined in claim 10, further comprising:

the at least one temperature sensor sensing fluid temperature downstream of the throat insert and upstream of the insert circulation port.

14. The jet pump assembly as defined in claim 10, further comprising:

the at least one temperature sensor sensing fluid temperature of the produced fluid in the through bore of the production intake section.

15. The jet pump assembly as defined in claim 5, further comprising:

at least one transmitter transmitting a fluid pressure signal from the at least one pressure sensor to the surface for modifying at least one jet pump assembly operating parameter.

16. The jet pump assembly as defined in claim 5, further comprising:

an insert assembly retainer to releasably retain the insert assembly in the pump housing; and a nozzle retainer to retain the nozzle in the nozzle inlet body.

17. A method of operating a jet pump assembly downhole in a subterranean wellbore for producing fluids from the subterranean wellbore, the jet pump assembly being suspended in the wellbore from the surface on a first tubular conduit, a second tubular conduit enclosing the jet pump assembly and the first tubular conduit, and a packoff seal hydraulically sealing the annular area between the jet pump assembly and the second tubular conduit, the method comprising:

connecting a housing tubing end of a pump housing to a downhole end of a first tubular conduit, the pump housing including at least one produced fluid conduit and at least one circulation port;

connecting one of the first or second tubular conduits at the surface to a power fluid source to transmit a pressurized power fluid from the surface to the jet pump assembly;

connecting the other of the first or second tubular conduits at the surface to a production facility to process returned fluids;

inserting an insert assembly in the downhole pump housing, the insert assembly including a production intake section, a diverter plug, a lower insert adapter and an upper insert adapter, and a power section including a nozzle inlet body, a nozzle, a throat insert and mixing tube body;

mixing produced fluid from the subterranean wellbore with the power fluid in the mixing tube body;

pumping the power fluid through one of the first and second tubular conduits and through the nozzle inlet body and through the nozzle to create a venturi effect in the power section to draw produced fluids into the throat insert to mix the power fluid with the produced fluid in the throat insert to form a mixed fluid, to conduct the mixed fluid out of the power section and through one of the lower and upper insert adapter and into the other of the first and second tubular conduit, and to lift the mixed fluid to the surface through the other of the first and second tubular conduit;

sensing at least one of a fluid pressure and a fluid temperature in the through bore of the insert assembly;

transmitting at least one fluid pressure signal and at least one fluid temperature signal to a recorder; and modifying at least one jet pump operating parameter in response to the sensed at least one fluid pressure signal and fluid temperature signal.

18. The jet pump assembly as defined in claim 17, wherein modifying the at least one jet pump operating parameter includes changing pressure in the power fluid.

19. The jet pump assembly as defined in claim 17, wherein modifying at least one jet pump operating parameter includes changing at least one of the nozzle and throat insert.

20. The jet pump assembly as defined in claim 17, wherein modifying at least one jet pump operating parameter includes reversing the directional orientation of the power section and reversing the circulation of fluids through the first and second tubular conduits.

* * * * *